US007452834B2

(12) United States Patent
Nagahara

(10) Patent No.: US 7,452,834 B2
(45) Date of Patent: Nov. 18, 2008

(54) FIBROUS SHEET

(75) Inventor: Shinsuke Nagahara, Tochigi (JP)

(73) Assignee: Kao Corporation, Tokyo (JP)

( * ) Notice: Subject to any disclaimer, the term of this patent is extended or adjusted under 35 U.S.C. 154(b) by 102 days.

(21) Appl. No.: 10/552,440

(22) PCT Filed: Apr. 6, 2004

(86) PCT No.: PCT/JP2004/004958

§ 371 (c)(1),
(2), (4) Date: Sep. 25, 2006

(87) PCT Pub. No.: WO2004/090215

PCT Pub. Date: Oct. 21, 2004

(65) Prior Publication Data

US 2007/0048511 A1 Mar. 1, 2007

(30) Foreign Application Priority Data

Apr. 10, 2003 (JP) ..... 2003-107064

(51) Int. Cl.
*B32B 21/02* (2006.01)

(52) U.S. Cl. ..... 442/385; 442/389; 442/416

(58) Field of Classification Search ..... 442/385, 442/389, 416
See application file for complete search history.

(56) References Cited

U.S. PATENT DOCUMENTS 4,704,112 A * 11/1987 Suzuki et al. ..... 604/378
5,635,290 A * 6/1997 Stopper et al. ..... 428/198
6,022,818 A * 2/2000 Welchel et al. ..... 442/384
6,468,931 B1 * 10/2002 Reeder et al. ..... 442/381
6,605,071 B1 * 8/2003 Gray et al. ..... 604/385.28
6,701,591 B2 * 3/2004 Collins et al. ..... 28/104
6,844,481 B2 * 1/2005 Taneichi et al. ..... 604/366
6,852,654 B2 * 2/2005 Fuller et al. ..... 442/408
7,115,535 B1 * 10/2006 Smith et al. ..... 442/123
7,311,209 B2 * 12/2007 Bentz et al. ..... 210/503

FOREIGN PATENT DOCUMENTS

JP 60-199962 A 10/1985
JP 8-24289 A 1/1996
JP 11-61617 A 3/1999
JP 11-229256 A 8/1999

* cited by examiner

*Primary Examiner*—N Edwards
(74) *Attorney, Agent, or Firm*—Birch, Stewart, Kolasch & Birch, LLP

(57) ABSTRACT

A fibrous sheet containing cotton fibers and at least two kinds of synthetic fibers is disclosed. The synthetic fibers form a nonwoven fabric. The cotton fibers enter a fiber network of the nonwoven fabric and interlace with the fiber network thereby to form a cotton fiber layer on one side of the nonwoven fabric, with part of the cotton fiber layer entering the nonwoven fabric. The synthetic fibers contain a combination of heat fusible fiber (a) and heat fusible fiber (b) having a small thickness than the fiber (a) or a combination of the fiber (a) and a fiber (c) that is not thermally bonded with the fiber (a).

10 Claims, 2 Drawing Sheets

FIBROUS SHEET

TECHNICAL FIELD

Figure 1:
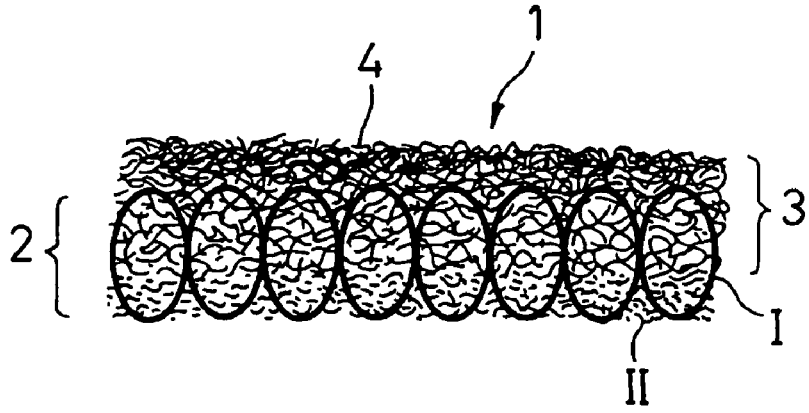

The present invention relates to a fibrous sheet having cotton fiber on at least one side thereof and a process of producing the same. The fibrous sheet of the present invention is particularly suited as a sheet brought into contact with the skin.

BACKGROUND ART

A body fluid absorbent article having, as a surface material, soft nonwoven fabric made of cotton fiber is known (see JP-A-8-24289). Produced by hydro-entanglement, the surface material has fibers closely entangled at a small fiber-to-fiber distance and therefore has a hard hand and lacks softness for use as a surface material to be brought into contact with the skin. Softness could be improved by reducing the weight of the surface material per unit area, which is difficult, however, because the surface material is made solely of cotton fiber. If reduction in weight is attempted, the lowest possible weight would be about 35 to 40 g/m$^2$. Moreover, since the surface material relies for its sheet form retention only on the entanglement of cotton fibers, it is difficult to expect sufficiently increased mechanical strength such as tensile strength. In general, to increase strength and to reduce weight conflict with each other.

Combining natural fiber such as cotton fiber with other fiber to reduce the weight of the cotton per unit area has been proposed in JP-A-60-199962. According to the proposed technique, a web of staple of natural fiber is laid on a network sheet and subjected to hydro-entanglement processing, whereby the web fibers are interlaced with themselves and with the network sheet. However, because it is the network sheet that the staple fibers are entangled with, the entangled staple fibers clog the mesh, resulting in a short interfiber distance, only to provide a stiff sheet with poor softness.

DISCLOSURE OF THE INVENTION

The present invention provides a fibrous sheet containing cotton fibers and at least two different kinds of synthetic fibers. The two or more synthetic fibers constitute nonwoven fabric. The cotton fibers enter a fiber network of the nonwoven fabric while being entangled with the fiber network to form a cotton fiber layer on one side of the nonwoven fabric. A part of the cotton fiber layer is in the nonwoven fabric. The two or more kinds of the synthetic fibers include a combination of a heat fusible fiber (a) and a heat fusible fiber (b) having a smaller thickness than the heat fusible fiber (a) or a combination of the fiber (a) and a fiber (c) which is not thermally bonded with the heat fusible fiber (a).

The present invention also provides a preferred process of producing the fibrous sheet of the invention. The process includes superposing a web of the cotton fibers on nonwoven fabric containing fiber (a) and fiber (b) or fiber (c) and directing water jets against the web side to have the cotton fibers enter the inside of the fiber network of the nonwoven fabric and entangle with the fiber network and, at the same time, to move the fibers (b) or the fibers (c) to the other side of the nonwoven fabric.

The present invention also provides a fibrous sheet containing cotton fibers and at least two different kinds of synthetic fibers. The two or more synthetic fibers constitute nonwoven fabric. The cotton fibers enter a fiber network of the nonwoven fabric while being entangled with the fiber network to form a cotton fiber layer on both sides of the nonwoven fabric. A part of each of the cotton fiber layers is in the nonwoven fabric. The two or more kinds of the synthetic fibers include a combination of a heat fusible fiber (a) and a heat fusible fiber (b) having a smaller thickness than the heat fusible fiber (a) or a combination of the fiber (a) and a fiber (c) which is not thermally bonded with the heat fusible fiber (a).

The present invention also provides an absorbent article having a liquid permeable topsheet, a liquid impermeable backsheet, and a liquid retentive absorbent member interposed between the two sheets, wherein the topsheet is either one of the above-described fibrous sheets.

DETAILED DESCRIPTION OF THE DRAWINGS

FIG. 1 schematically illustrates a cross-sectional structure of an embodiment of the fibrous sheet according to the present invention.

Figure 2:
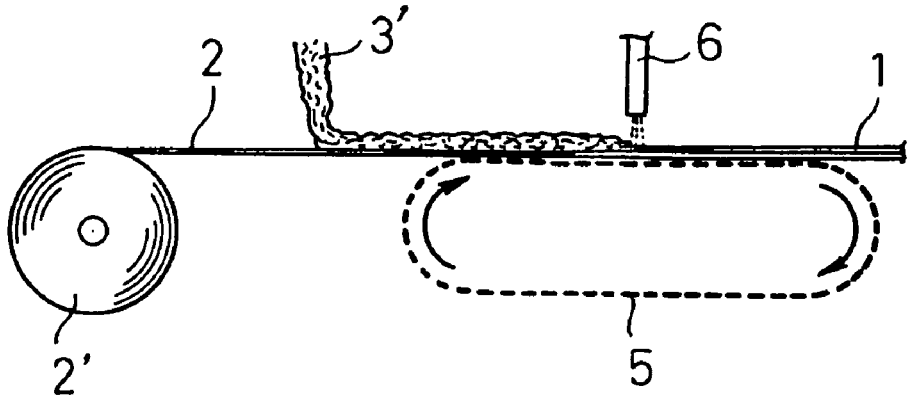

FIG. 2 illustrates the steps involved in the preparation of the fibrous sheet shown in FIG. 1.

Figure 3:
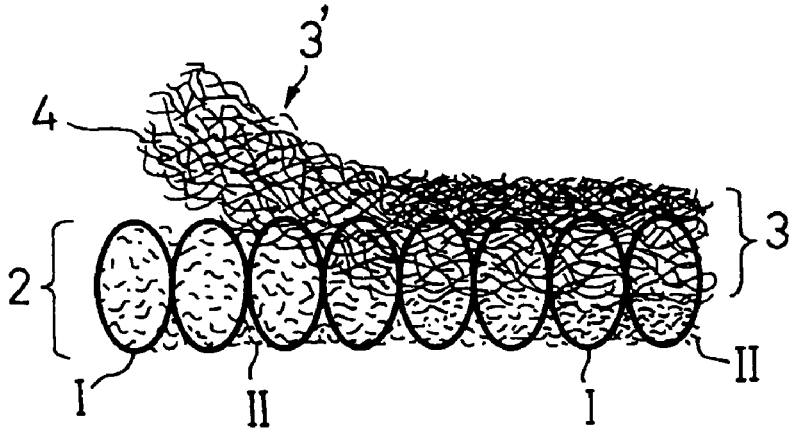

FIG. 3 schematically illustrates a cotton fiber web being interlaced with nonwoven fabric.

Figure 4:
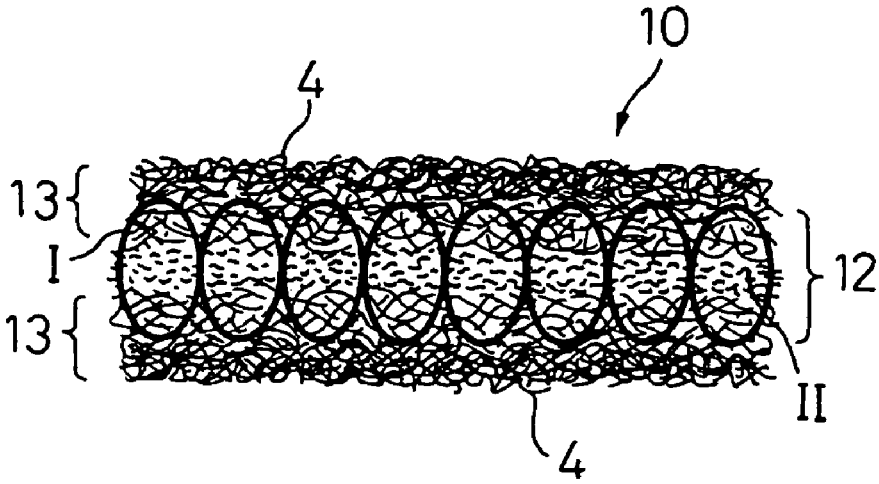

FIG. 4 schematically illustrates a cross-sectional structure of another embodiment of the fibrous sheet according to the present invention.

DETAILED DESCRIPTION OF THE INVENTION

The present invention relates to a cotton fiber-containing fibrous sheet having high strength as well as a soft hand and a process of producing the fibrous sheet.

The present invention will be described based on its preferred embodiments with reference to the accompanying drawings. FIG. 1 schematically illustrates a cross-sectional structure of an embodiment of the fibrous sheet according to the present invention. The fibrous sheet 1 is a composite sheet composed of a nonwoven fabric 2 made of synthetic fiber and a cotton fiber layer 3 on one side of the nonwoven fabric 2, with part of the cotton fiber layer 3 entering the nonwoven fabric 2.

The cotton fiber layer 3 is formed on one side of the nonwoven fabric 2. Cotton fibers 4 of the cotton fiber layer 3 enter the fiber network of the nonwoven fabric 2 and interlace with the fiber network. Understandably, the cotton fibers 4 interlace with each other. As illustrated in FIG. 1, the fibrous sheet 1 has the cotton fibers gradually decreasing from the side having the cotton fiber layer 3 to the side having no cotton fiber layer 3.

On the other hand, the nonwoven fabric 2 is made of two or more kinds of synthetic fibers and provides a network structure for interlacing the cotton fibers 4. The two or more kinds of synthetic fibers contain a combination of (a) a heat fusible fiber and (b) a heat fusible fiber having a thickness smaller than that of the heat fusible fiber (a) or a combination of the fiber (a) and (c) a fiber that is not fused with the heat fusible fiber (a).

The fiber (a) is used as a main component for fabricating the fiber network of the nonwoven fabric 2. Hence the fiber (a) will be called a network-forming fiber. The network-forming fiber preferably has a relatively large thickness to stably and securely form a fiber network, specifically a fineness of 3 to 16 dtex, more preferably 4 to 10 dtex. For the same purpose, the network-forming fiber is preferably made of a highly rigid synthetic resin. For example, the fiber network is preferably formed of a conjugate fiber containing polypropylene or polyester as a rigid component and polyethylene or low-melting polyester as a fusible component.

The fiber (b) or the fiber (c) is used to broaden the interfiber space in the fiber network when the cotton fibers 4 making up the cotton fiber layer 3 are interlaced with the fiber network of the nonwoven fabric 2. The details of broadening the interfiber space will be given later. Accordingly, the fibers (b) and (c) will hereinafter be inclusively referred to as an interfiber-space-broadening fiber.

The fiber (b) is a fiber whose diameter is smaller than that of the network-forming fiber. Specifically, the fineness (dtex) of the fiber (b) preferably ranges from about 5% to 80%, more preferably from about 10% to 50%, of that of the network-forming fiber in view of the ability to broaden the interfiber space of the fiber network. Part of the fiber (b) is fused to the network-forming fiber in the nonwoven fabric 2.

The fiber (c) is a fiber that is not fused with the network-forming fiber. The fiber that is not fused with the network-forming fiber includes (i) one which is essentially non-fusible and thus incapable of fusing with the network-forming fiber and (ii) one which is fusible but has not undergone a treatment causing fusion during the preparation of the nonwoven fabric 2 and, therefore, is not fused with the network-forming fiber. Unlike the fiber (b), the fiber (c) is not required to have a specific thickness relationship with the network-forming fiber. The fiber (c) includes fibers of synthetic resins having a higher melting point than synthetic resins constituting the network-forming fiber, including single component fibers made of synthetic resins, such as polyester, polypropylene, ethylene-propylene copolymers, and polyamide, and side-by-side or sheath/core conjugate fibers comprising two or more of these synthetic resins (fibers of this kind are generally heat fusible); and essentially non-fusible fibers such as rayon. Crimped fiber (i.e., latent crimping fiber having been crimped) is particularly preferred as the fiber (c). Crimped fiber is advantageous in that it hardly falls off and imparts extensibility to the fibrous sheet 1 thus making the fibrous sheet 1 soft, comfortable, and convenient to use. Another advantage of crimped fiber is that, where the latent crimping fibers are used in the preparation of the nonwoven fabric 2 such that they may be crimped after formation of a fiber web, the latent crimping fibers are easily entangled with the network-forming fibers during the fiber web forming processing such as carding. Entangled with the network-forming fibers, the latent crimping fibers having been crimped hardly fall off when exposed to water jets in the production of the fibrous sheet 1 (described infra). Furthermore, use of crimped fiber allows for appropriate control of the interfiber space broadening in the fiber network because the water jet pressure can loosen the helical crimp of crimped fibers to let the fibers extend or can release weak entanglement.

The fibrous sheet shown in FIG. 1 contains two kinds of synthetic fibers: network-forming fibers I and one kind of interfiber-space-broadening fibers II. There may be two or more kinds of the interfiber-space-broadening fibers II, for example, the fiber (b) and the fiber (c). In FIG. 1, the network-forming fibers I are schematically depicted as vertically elongated circles to visually emphasize that the network-forming fibers I form a bulky fiber network.

As illustrated in FIG. 1, the interfiber-space-broadening fibers II are localized in the side opposite to the side where the cotton fiber layer 3 is formed. This localization has broadened the interfiber space of the fiber network when the cotton fibers 4 constituting the cotton fiber layer 3 are interlaced with the fiber network of the nonwoven fabric 2. The details will be described later.

Having the above-described structure, the fibrous sheet 1 of the present embodiment produces the following advantageous effects (a), (b), and (c).

(a) In the cotton fiber layer 3, the constituent cotton fibers 4 have an increased interfiber distance and are prevented from clogging up as has been experienced in conventional cotton sheets. As a result, the cotton fiber layer 3 has a soft hand. More specifically, the cotton fiber layer 3 has a larger interfiber distance than any other cotton sheets prepared by hydroentanglement of cotton fibers under such conditions as to provide as large an interfiber distance as possible. Softness of the cotton sheet 1 can be evaluated as follows.

Softness of the fibrous sheet 1 is evaluated with a compression tester (KES-FB3, from Kato Tech Co., Ltd.). The maximum load of the tester being set at 49 $cN/cm^2$ (50 $gf/cm^2$), the value represented by $(T_0-T)/T_0$ is preferably in a range of from 0.5 to 0.9, wherein $T_0$ is the initial thickness (the thickness under a load of 0.5 $gf/cm^2$), and T is the thickness under the maximum load. The recited preferred value indicates improved softness (or cushioning properties) owing to the freedom from fibers' clogging up.

(b) When the fibrous sheet 1 is observed as a whole, since the cotton fibers 4 enter the inside of the nonwoven fabric 2, the amount of fibers gradually increases from the side of the fibrous sheet 1 where the cotton fiber layer is formed toward the center of the fibrous sheet 1 in the thickness direction. In other words, the fiber-to-fiber distance gradually decreases from the side of the fibrous sheet 1 where the cotton fiber layer is formed to the center of the fibrous sheet 1 in the thickness direction. It follows that the capillary force gradually increases from the side of the fibrous sheet 1 where the cotton fiber layer is formed to the center of the fibrous sheet 1 in the thickness direction. That is, there is a gradient in capillarity. When in contact with liquid, the fibrous sheet 1 exhibits improved liquid drawing properties from the cotton fiber layer side to the inside of the fibrous sheet, whereby the cotton fiber layer side provides a dry feel. Conventional cotton sheets feel wet on contact with liquid due to absorbency and hygroscopicity characteristic of cotton. The fibrous sheet according to the present invention is free of that inconvenience.

(c) Since part of the cotton fiber layer 3 enters the nonwoven fabric 2, the cotton fiber layer 3 has enhanced mechanical strength such as tensile strength as compared with a cotton sheet of equal weight and made of cotton fiber alone. This effect is particularly advantageous when the cotton fiber layer 3 is light-weight. For the cotton fiber layer 3 to have a reduced weight contributes to increased softness of itself.

In order for the nonwoven fabric 2 to have sufficiently high mechanical strength such as tensile strength and to sufficiently maintain the network and also in order to allow the cotton fibers to enter the nonwoven fabric 2, it is preferred for the nonwoven fabric 2 to contain 30% to 70% by mass, more preferably 40% by 60% by mass, of the network-forming fiber and 30% to 70% by mass, more preferably 40% to 60% by mass, of the interfiber-space-broadening fiber. The nonwoven fabric 2 may contain other fibers than the network-forming fiber I and the interfiber-space-broadening fiber II. Useful other fibers include dividual conjugate fibers composed of synthetic fibers such as polyester, polypropylene, ethylene-propylene copolymers, and polyamide; and fibers capable of improving capillarity of the nonwoven fabric 2 such as rayon and pulp. The capillarity depends on such factors as interstitial space diameter and hydrophilicity of the nonwoven fabric 2.

The cotton fiber layer 3 is made of cotton fibers commonly employed in the art. The cotton fiber layer 3 may consist solely of cotton fibers or may contain a small proportion of other fibers, such as rayon fiber, pulp fiber, and heat fusible fiber.

In order to sufficiently form the fiber network with which the cotton fibers 4 are interlaced and to secure the strength of the whole fibrous sheet 1, the nonwoven fabric 2 in the fibrous sheet 1 preferably has a weight of 15 to 80 g/m$^2$, more preferably 25 to 60 g/m$^2$. The cotton fiber layer 3, on the other hand, preferably has a weight of 5 to 30 g/m$^2$, more preferably 10 to 20 g/m$^2$, from the standpoint of sufficient softness and production cost. The weight of the fibrous sheet 1 is preferably 25 to 100 g/m$^2$, more preferably 35 to 80 g/m$^2$, from the viewpoint of hand and ease of handling.

The fibrous sheet 1 is suited for applications that come into contact with the skin, including a topsheet of absorbent articles, a facial sheet for makeup removal, towel, a wet cleaning sheet, and a dish cleaning sheet. When used in contact with the skin, the fibrous sheet 1 is used with the side of the cotton fiber layer 3 in contact with the skin.

Where the fibrous sheet 1 is used as, for instance, a topsheet of an absorbent article, the absorbent article is comprised of the fibrous sheet 1 as a topsheet, a liquid impermeable backsheet, and a liquid retentive absorbent member interposed between the topsheet and the backsheet. The topsheet is adapted to be brought into contact with a wearer, and the backsheet is adapted to face a garment. The backsheet includes film of various thermoplastic resins and a laminate composed of such film and nonwoven fabric. The absorbent member includes a mixture of fluff pulp and a superabsorbent polymer and paper containing a superabsorbent polymer. Absorbent articles having such a structure include sanitary napkins, panty liners, incontinence pads, and disposable diapers. In these applications, the fibrous sheet 1 is used in the absorbent article with its cotton fiber layer 3 facing a wearer's body as stated above. The absorbent article having the fibrous sheet 1 as a topsheet gives a wearer a pleasant comfort while worn by virtue of its soft hand. In addition, the high liquid drawing properties of the fibrous sheet 1 keep the skin facing side of the absorbent article dry, which enhances the wearing comfort of the absorbent article.

A preferred process of producing the fibrous sheet 1 shown in FIG. 1 will then be described. The first step is fabrication of the nonwoven fabric 2. The nonwoven fabric 2 is fabricated in commonly employed processes of producing nonwoven fabrics. Particularly preferred processes are a through-air bonding process and an air laying process, both furnishing a bulky fiber network. In making the nonwoven fabric 2 by a through-air bonding process, for instance, a mixture of network-forming fibers and interfiber-space-broadening fibers at a predetermined ratio is opened with a carding machine into a web. Hot air heated to a predetermined temperature is blown through the web to fuse the fiber intersections. When the fiber (b) is used as interfiber-space-broadening fibers, the result is fusion among the network-forming fibers, among the interfiber-space-broadening fibers, and between the interfiber-space-broadening fibers and the network-forming fibers thereby to give the nonwoven fabric 2. When the fiber (c) is used as interfiber-space-broadening fibers, the result is fusion among the network-forming fibers thereby to give the nonwoven fabric 2. Where latent crimping fibers are used as the fiber (c), hot air blowing is followed by heating the nonwoven fabric 2 at or above the crimping temperature of the latent crimping fibers to crimp the latent crimping fibers to develop a helical crimp. By this crimping, part of the network-forming fibers are caught in the helical crimps. Both the network-forming fibers and the interfiber-space-broadening fibers are uniformly distributed throughout the resulting nonwoven fabric 2. That is, neither of the fibers are localized in the nonwoven fabric 2.

Separately from the fabrication of the nonwoven fabric 2, a web of cotton fibers is prepared. A web of cotton fibers is obtained by opening a mass of cotton fibers by means of a carding machine.

The resulting cotton fiber web is superposed on the nonwoven fabric 2. This step is illustrated in FIG. 2. In FIG. 2, the nonwoven fabric 2 is unwound from a roll 2' and conveyed on a wire mesh, endless belt 5. A cotton fiber web 3' is superposed on the moving nonwoven fabric 2. In this condition, water jets from a jet nozzle 6 are directed to the cotton fiber web 3'. This situation is illustrated in FIG. 3.

As illustrated in FIG. 3, when the water jets strike the web, entanglement occurs in the cotton fiber web 3' between the cotton fibers 4 and between a cotton fiber 4 and the constituent fiber of the nonwoven fabric 2, i.e., the fiber network. In the nonwoven fabric 2, the network-forming fibers I retain the fiber network against the pressure of the water jets whereas the interfiber-space-broadening fibers II are forcibly moved downward, that is, toward the side opposite to the side where the cotton fiber web 3' is superposed, by the pressure of the water jets. In short, the interfiber-space-broadening fibers II are localized in the opposite side. Specifically, in case of using the fiber (b) as interfiber-space-broadening fibers II, because the fiber (b) is fine and thus has a small content of a fusible component, the thermal fusion bond between the fibers (b) and the network-forming fibers I is weak. Therefore, the fusion bonds of the two fibers is easily destroyed and, as a result, the fibers (b) are made to move. In case of using the fiber (c) as interfiber-space-broadening fibers II, because the fibers (c) are not fused to the network-forming fibers I, they are made to move by the pressure of the water jets. In case where the fiber (c) is a crimped fiber, there is the following advantage. Because the fibers (c) have caught part of the network-forming fibers in their helical crimp as previously mentioned and also because the helix is extensible, the crimped fibers do not move excessively even under the pressure of the water jets. As a result, the movement of the crimped fibers is controlled so that interfiber spaces formed solely of the network-forming fibers I may be provided moderately. In other words, when crimped fibers are used as the fiber (c), the crimped fibers move with their helix loosened and extended by the water jets thereby to leave interfiber spaces of the network-forming fibers I. Afterward, the loosened helix contracts, and the crimped fibers return to or near the position before the movement. Therefore, excessive localization is averted.

As a result of the movement of the interfiber-space-broadening fibers II, there is left the fiber network formed of the network-forming fibers I alone in the part where the interfiber-space-broadening fibers II have existed. That is, the interfiber space in that part becomes broader than that before receiving the pressure of the water jets. In other words, the interfiber distance in the interfiber space of that part is longer than before. The broadened interfiber spaces allow the cotton fibers 4 to enter more easily and to interlace with the fiber network more easily. If the nonwoven fabric 2 is made up of the network-forming fibers I alone without using the interfiber-space-broadening fibers II, it would be extremely difficult to secure sufficient interfiber spaces in the nonwoven fabric 2. According to the present invention, a combined use of the network-forming fibers I that constitute the fiber network and the interfiber-space-broadening fibers II that are movable by the pressure of water jets has made it possible for the first time to secure sufficient interfiber spaces, whereby the cotton fibers 4 are allowed to enter the nonwoven fabric 2 sufficiently and to interlace.

In this way, the cotton fiber layer 3 made of the cotton fibers 4 is formed on one side of the nonwoven fabric to provide the fibrous sheet 1.

As described hereinbefore, a fiber of the type that is movable by a water jet and thus localized and/or a fiber of the type that is movable by a water jet but returns to the original position and is therefore not greatly localized is/are used in the present invention. Use of the former fiber offers the advantage that a capillarity gradient is created in the fibrous sheet 1. Use of the latter fiber provides the advantage that fall-off of fibers is suppressed and that the fibrous sheet exhibits extensibility.

Another embodiment of the present invention is described by referring to FIG. 4. The description of the first mentioned embodiment applies appropriately to those particulars that are not referred to hereunder. Reference numerals common to FIGS. 1 and 4 represent the same elements.

As illustrated in FIG. 4, the fibrous sheet 10 of the present embodiment (second embodiment) is a composite sheet composed of a nonwoven fabric 12 made of a synthetic fiber and a cotton fiber layer 13 on both sides of the nonwoven fabric 12. Part of the cotton fiber layer 13 on each side enter the nonwoven fabric 12. The amount of cotton fibers 4 gradually decreases from both sides of the fibrous sheet 10 where the cotton fiber layers 13 are formed toward the center of the fibrous sheet 10 in the thickness direction. When the fibrous sheet 10 is observed as a whole, the amount of fibers gradually increases from the both sides of the fibrous sheet 10 where the cotton fiber layers 13 are formed toward the center of the fibrous sheet 10 in the thickness direction. In other words, the fiber-to-fiber distance gradually decreases from both the sides where the cotton fiber layers 13 are formed toward the center of the fibrous sheet 10 in the thickness direction. It follows that the capillarity force gradually increases from the sides of the cotton fibrous sheets 13 to the center of the fibrous sheet 10 in the thickness direction. That is, there is a gradient in capillarity. Even when in contact with liquid, the fibrous sheet 10 exhibits improved liquid drawing properties from the cotton fiber layer sides to the inside of the sheet, whereby the fibrous sheet 10 feels dry.

The fibrous sheet 10 according to the second embodiment can be used with either side of which in contact with the skin because it has the cotton fiber layer 13 on both sides thereof.

The present invention is by no means limited to the foregoing embodiments. For example, while in FIG. 1 the fibrous sheet 1 is depicted as if it does not have cotton fibers on the surface opposite to the side with the cotton fiber layer 3, cotton fibers may exist on the side where the cotton fiber layer 3 is not formed.

INDUSTRIAL APPLICABILITY

The fibrous sheet of the present invention has a soft hand because clogging up of cotton fibers, which has often been encountered in the production of conventional cotton sheets, is prevented. The fibrous sheet of the invention provides a gradient of capillarity from the cotton fiber layer side to the inside of the sheet to exhibit high liquid-drawing properties. Therefore, even when brought into contact with liquid, the fibrous sheet keeps a dry feel on its cotton fiber layer side. The cotton fiber layer in the fibrous sheet of the present invention is stronger, e.g., in tensile strength than a cotton sheet of the same weight per unit area made solely of cotton fiber, which allows for reduction in weight of the cotton fiber layer. Reduction in weight of the cotton fiber layer is advantageous for enhancement of softness of the cotton fiber layer.

The invention claimed is:

1. A fibrous sheet containing cotton fibers and at least two different kinds of synthetic fibers, the at least two kinds of synthetic fibers forming nonwoven fabric, the cotton fibers entering a fiber network of the nonwoven fabric while being entangled with the fiber network to form a cotton fiber layer on one side of the nonwoven fabric, with part of the cotton fiber layer being in the nonwoven fabric, and the at least two kinds of the synthetic fibers including a combination of a heat fusible fiber (a) and a heat fusible fiber (b) having a smaller thickness than the heat fusible fiber (a) or a combination of the fiber (a) and a fiber (c) which is not thermally bonded with the heat fusible fiber (a); and wherein the distance between fibers gradually decreases from the side with the cotton fiber layer being presented to the center of the thickness of the fibrous sheet.

2. The fibrous sheet according to claim 1, wherein the nonwoven fabric contains 30% to 70% by weight of the fiber (a) and 30% to 70% by weight of the fiber (b) or the fiber (c).

3. The fibrous sheet according to claim 1, wherein the amount of the cotton fibers gradually decreases from the side with the cotton fiber layer being presented to the side with no cotton fiber layer being presented.

4. The fibrous sheet according to claim 1, wherein the fiber (c) is a latent crimping fiber which has been crimped.

5. The fibrous sheet according to claim 1, wherein the distance between fibers in the cotton fiber layer is longer than that of a cotton sheet which is made of the same kind of cotton fiber and is produced by hydro-entanglement.

6. The fibrous sheet according to claim 1, wherein the fiber (b) or the fiber (c) is localized in the side of said nonwoven fabric with no cotton fiber layer being presented.

7. A process of producing the fibrous sheet according to claim 1, comprising:

superposing a web of the cotton fibers on a nonwoven fabric containing the fiber (a) and the fiber (b) or (c) and directing water jets against the web side to have the cotton fibers enter the inside of a fiber network of the nonwoven fabric and entangle with the fiber network and, at the same time, to move the fiber (b) or the fiber (c) to the other side of the nonwoven fabric.

8. A fibrous sheet containing cotton fibers and at least two different kinds of synthetic fibers, the at least two kinds of synthetic fibers form nonwoven fabric, the cotton fibers entering a fiber network of the nonwoven fabric while being entangled with the fiber network to form a cotton fiber layer on both sides of the nonwoven fabric, with part of each of the cotton fiber layers being in the nonwoven fabric, and the at least two kinds of the synthetic fibers including a combination of a heat fusible fiber (a) and a heat fusible fiber (b) having a smaller thickness than the heat fusible fiber (a) or a combination of the fiber (a) and a fiber (c) which is not thermally bonded with the heat fusible fiber (a); and wherein the distance between fibers gradually decreases from the side with the cotton fiber layer being presented to the center of the thickness of the fibrous sheet.

9. The fibrous sheet according to claim 8, wherein the amount of the cotton fibers gradually decreases from each of the sides with the cotton fiber layer being presented to the center of the thickness of the fibrous sheet.

10. An absorbent article comprising a liquid permeable topsheet, a liquid impermeable backsheet, and a liquid retentive absorbent member interposed between the top sheet and the backsheet, wherein the topsheet is the fibrous sheet according to claim 1 or 8.

* * * * *